US011031230B2

(12) United States Patent
Jones et al.

(10) Patent No.: US 11,031,230 B2
(45) Date of Patent: Jun. 8, 2021

(54) DATA DIRECTED DESI-MS IMAGING

(71) Applicant: MICROMASS UK LIMITED, Wilmslow (GB)

(72) Inventors: Emrys Jones, Manchester (GB); Richard Chapman, Runcorn (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 254 days.

(21) Appl. No.: 16/306,809

(22) PCT Filed: Jun. 5, 2017

(86) PCT No.: PCT/GB2017/051604
§ 371 (c)(1),
(2) Date: Dec. 3, 2018

(87) PCT Pub. No.: WO2017/208025
PCT Pub. Date: Dec. 7, 2017

(65) Prior Publication Data

US 2019/0304768 A1 Oct. 3, 2019

(30) Foreign Application Priority Data

Jun. 3, 2016 (GB) ..... 1609747

(51) Int. Cl.
*H01J 49/28* (2006.01)
*H01J 49/16* (2006.01)
(Continued)

(52) U.S. Cl.
CPC ..... *H01J 49/165* (2013.01); *H01J 49/0004* (2013.01); *H01J 49/142* (2013.01); *H01J 49/28* (2013.01)

(58) Field of Classification Search
CPC .... H01J 49/165; H01J 49/0004; H01J 49/142; H01J 49/28
See application file for complete search history.

(56) References Cited

U.S. PATENT DOCUMENTS 7,655,476 B2 2/2010 Bui
2004/0173743 A1 9/2004 Valaskovic et al.
(Continued)

FOREIGN PATENT DOCUMENTS

CN 102332387 A 1/2012
CN 102741965 A 10/2012
(Continued)

OTHER PUBLICATIONS

International Search Report and Written Opinion for International Application No. PCT/GB2017/051616, dated Aug. 9, 2017, 9 pages.
(Continued)

*Primary Examiner* — Brian J. Sines
(74) *Attorney, Agent, or Firm* — Kacvinsky Daisak Bluni PLLC

(57) ABSTRACT

A method of analysing a sample is disclosed that comprises surveying a sample in a first mode of operation by directing a spray of charged droplets onto the sample, determining one or more regions of interest in the sample, and analysing the one or more regions of interest in a second different mode of operation by directing a spray of charged droplets onto the sample. The spot size of the spray of charged droplets at a point of impact with the sample may be varied.

15 Claims, 5 Drawing Sheets

(51) Int. Cl.
*H01J 49/00* (2006.01)
*H01J 49/14* (2006.01)

(56) References Cited

U.S. PATENT DOCUMENTS

| | | | | |
|---|---|---|---|---|
| 2007/0141719 | A1 | 6/2007 | Bui | |
| 2008/0017793 | A1* | 1/2008 | James | H01J 49/0004 250/288 |
| 2010/0078550 | A1 | 4/2010 | Wiseman et al. | |
| 2014/0316717 | A1* | 10/2014 | Ikegami | H01J 49/0036 702/23 |
| 2016/0155620 | A1 | 6/2016 | Makarov | |
| 2017/0221687 | A1* | 8/2017 | Stauber | G06K 9/00147 |
| 2017/0368205 | A1* | 12/2017 | Zarrine-Afsar | G01N 27/00 |
| 2018/0366313 | A1* | 12/2018 | Hoyes | H01J 49/062 |

FOREIGN PATENT DOCUMENTS

| | | | |
|---|---|---|---|
| JP | H1048183 | A | 2/1998 |
| WO | 2002095362 | A2 | 11/2002 |

OTHER PUBLICATIONS

Search Report under Section 17(5) for United Kingdom Application No. GB1609743.8, dated Nov. 7, 2016, 6 pages.
Green, F.M. et al., "Developing Repeatable Measurements for Reliable Analysis of Molecules at Surfaces Using Desoprtion Electrospray Ionizataion", Analytical Chemistry, 81(6):2286-2293, Mar. 15, 2009.
Wood, M.C. et al., "Microscopic Imaging of Glass Surfaces under the Effects of Desorption Electrospray Ionization", Analytical Chemistry, 81(15):6407-6415, Jul. 9, 2009.
International Search Report and Written Opinion for International Application No. PCT/GB2017/051604, dated Aug. 7, 2017, 16 pages.
Search Report under Section 17(5) for United Kingdom Patent Application No. GB1609747.9, dated Nov. 9, 2016, 12 pages.
Claude et al., "Multiple, Sequential DESI Images from a Single Tissue Section at Different Spatial Resolution", Feb. 2015, URL:http://www.waters.com/waters/library.htm?locale=en GB&lid=134833822&cid=511436, retrieved from the Internet on Jul. 7, 2016.
Takats et al., "Ambient Mass Spectrometry Using Desorption Electrospray Ionization (DESI): Instrumentation, Mechanisms and Applications in Forensics, Chemistry, and Biology", Journal of Mass Spectrometry, 40(10): 1261-1275, Oct. 1, 2005.
Claude et al.,"Generation of Multiple Images from a Single Tissue Section with Dual Polarity Desorption Electrospray Ionization Mass Spectrometry", Mar. 18, 2015, URL:http://maldi-msi.org/wp/wp-content/uploads/2015/03/DESI-Generation%20of%20multiple%20images.pdf, retrieved from the Internet on Jul. 27, 2017.
Campbell et al., "Improved Spatial Resolution in the Imaging of Biological Tissue Using Desorption Electrospray ionization", Analytical and Bioanalytical Chemistry, 404(2):389-398, Jun. 16, 2012.
Takats et al, "Mass Spectrometry Sampling Under Ambient Conditions with Desorption Electrospray Ionization", Science, 306, pp. 471-473, Oct. 15, 2004.
Ifa et al., "Tissue Imprint Imaging by Desorption Electrospray Ionization Mass Spectrometry", Analytical Methods, 2011 (3):1910-1912. Jun. 2011.
Muller et al., "Direct Plant Tissue Analysis and Imprint Imaging by Desorption Electrospray Ionization Mass Spectrometry", Analytical Chemistry, 2011(83): 5754-5761.
Venter, A., et al., "Droplet Dynamics and Ionization Mechanisms in Desorption Electrospray Ionization Mass Spectrometry" Anal Chem. 78:8549-8555 (2006).

* cited by examiner

DATA DIRECTED DESI-MS IMAGING

CROSS-REFERENCE TO RELATED APPLICATIONS

This application is a national phase filing claiming the benefit of and priority to International Patent Application No. PCT/GB2017/051604, filed on Jun. 5, 2017, which claims priority from and the benefit of United Kingdom patent application No. 1609747.9 filed on Jun. 3, 2016. The entire contents of these applications are incorporated herein by reference.

FIELD OF THE INVENTION

The present invention relates generally to mass spectrometers and in particular to methods of imaging a sample using a mass spectrometer.

BACKGROUND

In mass spectrometry imaging, the spatial distribution of the composition of a sample is visualised by analysing ions produced from multiple spatially separated regions of the sample.

Mass spectrometry imaging of a sample can be very time consuming. For example, the analysis of a sample deposited on a typical glass slide can take many hours and even days.

U.S. Pat. No. 7,655,476 (Bui) discloses a method for reducing analysis times in imaging mass spectrometry. An initial tissue imaging scan is performed to obtain a mass spectral image at relatively low resolution (i.e. with relatively large average spacing between adjacent target regions) in order to identify areas of interests within the tissue sample, and a subsequent scan of the areas of interest is performed with reduced target region spacing to obtain high-resolution mass spectral imaging of the areas of interest. The technique described in U.S. Pat. No. 7,655,476 (Bui) is based on Matrix-Assisted Laser Desorption Ionisation ("MALDI").

Although this technique reduces the overall analysis time for a sample, it can also reduce the quality of the overall analysis. In particular, sample areas of interest can be missed by the initial low resolution imaging scan, and will not then be analysed in the subsequent scan, and so will not be analysed at all.

Furthermore, the use of Matrix-Assisted Laser Desorption Ionisation ("MALDI") techniques requires a time consuming matrix deposition sample preparation step. This step can give rise to variability in the experiment because the matrix can vary across the sample and between samples, and can be unstable over the timescale of an experiment.

It is desired to provide an improved method of mass spectrometry imaging.

SUMMARY

According to an aspect there is provided a method of analysing a sample comprising:

(i) surveying a sample in a first mode of operation by directing a spray of charged droplets onto the sample;

(ii) determining one or more regions of interest in the sample; and (iii) analysing the one or more regions of interest in a second different mode of operation by directing a spray of charged droplets onto the sample.

The various embodiments described herein are directed to methods of analysing a sample in which a sample is initially surveyed in a first mode of operation, one or more regions of interest in the sample are determined, and then the one or more regions of interest are analysed in a second different mode of operation. Accordingly, the overall analysis time for the sample can be reduced by identifying one or more regions of interest in a "survey scan" and then analysing the identified region(s) in a subsequent scan.

However, in contrast to the approach disclosed in U.S. Pat. No. 7,655,476 (Bui), the sample is analysed by directing a spray of charged droplets onto the sample, e.g., using Desorption Electrospray Ionisation ("DESI"). The Applicants have found that this has a number of benefits when compared to the Matrix-Assisted Laser Desorption Ionisation ("MALDI") techniques described in U.S. Pat. No. 7,655,476 (Bui).

In particular, the possibility of missing sample areas of interest in the survey scan can be substantially reduced, so that the quality of the overall analysis can be greatly improved.

This is because MALDI sampling events significantly alter the surface of the sample as the matrix crystals are consumed within the region of the laser spot. Sampled regions cannot then be sampled again (without, e.g., removing the sample from the mass spectrometer, recoating the sample with matrix, etc.).

Accordingly, in the initial low resolution imaging scan disclosed in U.S. Pat. No. 7,655,476 (Bui), a sub-set of a high-resolution array of target regions are sampled, areas of interests are identified, and then target regions of the high-resolution array of target regions are "filled in" for the areas of interest (i.e., such that different target regions are sampled in the initial and subsequent imaging scans). Since only a sub-set of a high-resolution array of target regions are sampled in the initial scan, sample areas of interest can be missed. Although as described in U.S. Pat. No. 7,655,476 (Bui) this effect can be reduced by using a randomized distribution of target regions in the initial scan, it cannot be completely removed.

In contrast, sampling events in which a spray of charged droplets is directed onto the sample (e.g., DESI sampling events) in accordance with embodiments described herein leave the sample virtually unaltered.

Accordingly, the survey scan according to various embodiments described herein may encompass significantly more of the sample (when compared to the approach disclosed in U.S. Pat. No. 7,655,476 (Bui)), and may encompass substantially all of the sample, without affecting the subsequent scan. This means that the possibility of missing sample areas of interest in the survey scan can be substantially reduced, and so the quality of the overall analysis can be substantially increased.

Furthermore, the use of a spray of charged droplets (e.g., DESI) to analyse a sample in accordance with embodiments described herein can reduce the time and effort required for sample preparation, and can increase the stability and reproducibility of the analysis. This is because a matrix deposition sample preparation step is not required before or during the analysis of the sample in embodiments described herein.

It will be appreciated therefore that the various embodiments described herein provide an improved method of mass spectrometry imaging.

The step of (i) surveying the sample in the first mode of operation may comprise surveying the sample at a first resolution; and the step of (iii) analysing the one or more regions of interest in the second different mode of operation may comprise analysing the one or more regions of interest at a second different resolution.

The second resolution may be greater than the first resolution.

The step of (i) surveying the sample at the first resolution may comprise directing the spray of charged droplets onto the sample when the spray has a first cross-sectional area or first pixel size at a point of impact with the sample; and the step of (iii) analysing the one or more regions of interest at the second different resolution may comprise directing the spray of charged droplets onto the sample when the spray has a second different cross-sectional area or second different pixel size at a point of impact with the sample.

The second cross-sectional area or second pixel size may be smaller than the first cross-sectional area or first pixel size.

The first and/or second cross-sectional area or pixel size may be selected from the group consisting of:

(i) <100 $\mu m^2$; (ii) 100-200 $\mu m^2$; (iii) 200-500 $\mu m^2$; (iv) 500-1000 $\mu m^2$; (v) 1000-2000 $\mu m^2$; (vi) 2000-5000 $\mu m^2$; (vii) 5000-10000 $\mu m^2$; (viii) 10000-20000 $\mu m^2$; (ix) 20000-40000 $\mu m^2$; (x) 40000-60000 $\mu m^2$; (xi) 60000-80000 $\mu m^2$; (xii) 80000-100000 $\mu m^2$; (xiii) 0.1-0.2 $mm^2$; (xiv) 0.2-0.4 $mm^2$; (xv) 0.4-0.6 $mm^2$; (xvi) 0.6-0.8 $mm^2$; (xvii) 0.8-1 $mm^2$; (xviii) 1-1.2 $mm^2$; (xix) 1.2-1.4 $mm^2$; (xx) 1.4-1.6 $mm^2$; (xxi) 1.6-1.8 $mm^2$; (xxii) 1.8-2 $mm^2$; and (xxiii) >2 $mm^2$.

The step of (i) surveying the sample in the first mode of operation may comprise surveying the sample by scanning the spray of charged droplets across the sample; and the step of (iii) analysing the one or more regions of interest in the second different mode of operation may comprise analysing the one or more regions of interest by scanning the spray of charged droplets across the one or more regions of interest.

The step of (i) surveying the sample in the first mode of operation may comprise surveying the sample by scanning the spray of charged droplets across the sample at a first speed; and the step of (iii) analysing the one or more regions of interest in the second different mode of operation may comprise analysing the one or more regions of interest by scanning the spray of charged droplets across the one or more regions of interest at a second different speed.

The first speed may be greater than the second speed.

The step of (i) surveying the sample in the first mode of operation may comprise surveying the sample by directing the spray of charged droplets onto a plurality of first target regions of the sample; and the step of (iii) analysing the one or more regions of interest in the second different mode of operation may comprise analysing the one or more regions of interest by directing the spray of charged droplets onto a plurality of second target regions of the one or more regions of interest.

The step of (i) surveying the sample in the first mode of operation may comprise surveying the sample by directing the spray of charged droplets onto a plurality of first target regions of the sample, wherein the spray of charged droplets is directed onto each of the plurality of first target regions for a first dwell time; and the step of (iii) analysing the one or more regions of interest in the second different mode of operation may comprise analysing the one or more regions of interest by directing the spray of charged droplets onto a plurality of second target regions of the one or more regions of interest, wherein the spray of charged droplets is directed onto each of the plurality of second target regions for a second different dwell time.

The first dwell time may be less than the second dwell time.

The first and/or second dwell time may be selected from the group consisting of: (i) <0.1 s; (ii) about 0.1-0.2 s; (iii) about 0.2-0.4 s; (iv) about 0.4-0.6 s; (v) about 0.6-0.8 s; (vi) about 0.8-1 s; (vii) about 1-1.2 s; (viii) about 1.2-1.4 s; (ix) about 1.4-1.6 s; (x) about 1.6-1.8 s; (xi) about 1.8-2 s; and (xii) >2 s.

The step of (i) surveying the sample in the first mode of operation may comprise surveying the sample in the first mode of operation during a first time period; and the step of (iii) analysing the one or more regions of interest in the second different mode of operation may comprise analysing the one or more regions of interest in the second mode of operation during a second time period.

The first time period may be less than the second time period.

The first and/or second time period may be selected from the group consisting of: (i) <30 s; (ii) about 30-60 s; (iii) about 1-2 min; (iv) about 2-5 min; (v) about 5-10 min; (vi) about 10-20 min; (vii) about 20-40 min; (viii) about 40-60 min; (ix) about 60-80 min; (x) about 80-100 min; (xi) about 100-120 min; and (xii) >120 min.

The step of (i) surveying the sample in the first mode of operation may comprise directing the spray of charged droplets onto one or more first regions of the sample; and the step of (iii) analysing the one or more regions of interest in the second different mode of operation may comprise directing the spray of charged droplets onto the one or more regions of interest;

wherein at least some of the one or more regions of interest may be the same as or overlap with at least some of the one or more first regions.

At least (i) 1%, (ii) 5%, (iii) 10%, (iv) 20%, (v) 30%, (vi) 40%, (vii) 50%, (viii) 60%, (ix) 70%, (x) 80%, (xi) 90%, (xii) 95%, or (xiii) 99% of the one or more regions of interest may be the same as or overlap with the one or more first regions.

The step of (i) surveying the sample in the first mode of operation may comprise analysing most or all of the area of the sample.

The step of (i) surveying the sample in the first mode of operation may comprise analysing at least (i) 50%, (ii) 60%, (iii) 70%, (iv) 80%, (v) 90%, (vi) 95%, or (vii) 99% of the area of the sample.

The step of (i) surveying the sample in the first mode of operation may comprise directing the spray of charged droplets onto the sample, wherein the charged droplets have a first polarity; and the step of (iii) analysing the one or more regions of interest in the second different mode of operation may comprise directing the spray of charged droplets onto the sample, wherein the charged droplets have a second different polarity.

Directing the spray of charged droplets onto the sample may comprise directing solvent ions onto the sample.

The step of (i) surveying the sample in the first mode of operation may comprise directing the spray of charged droplets onto the sample, wherein the charged droplets comprise a first solvent or solvent composition; and the step of (iii) analysing the one or more regions of interest in the second different mode of operation may comprise directing the spray of charged droplets onto the sample, wherein the charged droplets comprise a second different solvent or solvent composition.

The first and/or second mode of operation may comprise: a mass spectrometry ("MS") mode of operation; a tandem mass spectrometry ("MS/MS") mode of operation; a mode of operation in which parent or precursor ions are alternatively fragmented or reacted to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation; a Quantification mode of operation; or an Ion Mobility Spectrometry ("IMS") mode of operation.

The first and/or second mode of operation may comprise: (i) a Collisional Induced Dissociation ("CID") mode of operation; (ii) a Surface Induced Dissociation ("SID") mode of operation; (iii) an Electron Transfer Dissociation ("ETD") mode of operation; (iv) an Electron Capture Dissociation ("ECD") mode of operation; (v) an Electron Collision or Impact Dissociation mode of operation; (vi) a Photo Induced Dissociation ("PID") mode of operation; (vii) a Laser Induced Dissociation mode of operation; (viii) an infrared radiation induced dissociation mode of operation; (ix) an ultraviolet radiation induced dissociation mode of operation; (x) a nozzle-skimmer interface fragmentation mode of operation; (xi) an in-source fragmentation mode of operation; (xii) an in-source Collision Induced Dissociation mode of operation; (xiii) a thermal fragmentation mode of operation; (xiv) an electric field induced fragmentation mode of operation; (xv) a magnetic field induced fragmentation mode of operation; (xvi) an enzyme digestion or enzyme degradation fragmentation mode of operation; (xvii) an ion-ion reaction fragmentation mode of operation; (xviii) an ion-molecule reaction fragmentation mode of operation; (xix) an ion-atom reaction fragmentation mode of operation; (xx) an ion-metastable ion reaction fragmentation mode of operation; (xxi) an ion-metastable molecule reaction fragmentation mode of operation; (xxii) an ion-metastable atom reaction fragmentation mode of operation; (xxiii) an ion-ion reaction mode of operation wherein ions react to form adduct or product ions; (xxiv) an ion-molecule reaction mode of operation wherein ions react to form adduct or product ions; (xxv) an ion-atom reaction mode of operation wherein ions react to form adduct or product ions; (xxvi) an ion-metastable ion reaction mode of operation wherein ions react to form adduct or product ions; (xxvii) an ion-metastable molecule reaction mode of operation wherein ions react to form adduct or product ions; (xxviii) an ion-metastable atom reaction mode of operation wherein ions react to form adduct or product ions; or (xxix) an Electron Ionisation Dissociation ("EID") mode of operation.

The second mode of operation may comprise an optimised version of the first mode of operation.

The method may comprise selecting and/or optimising the second mode of operation based on information acquired during the first mode of operation.

The step of (i) surveying the sample in the first mode of operation may comprise surveying the sample and one or more regions surrounding the sample by directing the spray of charged droplets onto the sample and onto the one or more regions surrounding the sample.

The sample may be mounted on a substrate or slide, and the step of (i) surveying the sample in the first mode of operation may comprise surveying most or all of the area of the substrate or slide including the sample.

The step of (i) surveying the sample in the first mode of operation may comprise surveying at least (i) 50%, (ii) 60%, (iii) 70%, (iv) 80%, (v) 90%, (vi) 95%, or (vii) 99% of the area of the substrate or slide including the sample.

The step of (ii) determining one or more regions of interest in the sample may comprise determining one or more boundaries of the sample.

The step of (iii) analysing the one or more regions of interest in the second different mode of operation may comprise analysing most or all of the area of the sample.

The step of (iii) analysing the one or more regions of interest in the second different mode of operation may comprise analysing at least (i) 50%, (ii) 60%, (iii) 70%, (iv) 80%, (v) 90%, (vi) 95%, or (vii) 99% of the area of the sample.

The step of (iii) analysing the one or more regions of interest in the second different mode of operation may comprise analysing only the sample.

The step of (ii) determining one or more regions of interest in the sample may comprise determining one or more regions in the sample that have one or more particular properties.

The one or more particular properties may comprise: (i) one or more histological properties; (ii) one or more tissue types; (iii) one or more molecular types or classes; (iv) one or more ions of interest; (v) one or more disease types; and/or (v) one or more drugs or drug metabolites.

The method may comprise:

(i) surveying most or all of the sample in the first mode of operation;

(ii) determining the one or more regions of interest in the sample; and then (iii) analysing the one or more regions of interest in the second different mode of operation.

The method may comprise:

(i) surveying a portion of the sample in the first mode of operation; and (ii) determining one or more regions of interest in the portion of the sample; wherein when one or more regions of interest are determined in the portion of the sample, then the method comprises:

(iii) analysing the one or more regions of interest in the second different mode of operation.

The method may comprise:

(iv) surveying another portion of the sample in the first mode of operation after the step of (iii) analysing the one or more regions of interest in the second different mode of operation.

The step of (i) surveying the sample in the first mode of operation may comprise generating analyte ions.

The step of (iii) analysing the one or more regions of interest in the second mode of operation may comprise generating analyte ions.

The method may comprise mass analysing the analyte ions or ions derived from the analyte ions.

The method may comprise determining the ion mobility, collision cross section or interaction cross section of the analyte ions or ions derived from the analyte ions.

The steps (i), (ii) and (iii) may be performed during the course of a single experimental acquisition.

The steps (i) and (iii) may be performed automatically without user interaction.

The steps (i), (ii) and (iii) may be performed automatically without user interaction.

The method may comprise mounting the sample onto a substrate or slide before the steps (i), (ii) and (iii).

The method may comprise loading the sample into an instrument before the steps (i), (ii) and (iii).

The step of loading the sample into the instrument may be performed automatically without user interaction.

The method may comprise repeating the steps (i), (ii) and (iii) a plurality of times for a plurality of different samples.

The method may comprise automatically repeating the steps (i), (ii) and (iii) the plurality of times for the plurality of different samples without user interaction.

The charged droplets may comprise microdroplets.

The sample may comprise: (i) a tissue section; (ii) a living or non-living tissue sample; and/or (iii) a histopathology sample.

Directing the spray of charged droplets onto the sample may comprise directing the spray of charged droplets onto the sample at about atmospheric pressure.

Directing the spray of charged droplets onto the sample may comprise ionising the sample using Desorption Electrospray Ionisation ("DESI").

According to another aspect there is provided apparatus for analysing a sample comprising:

a device arranged and adapted to direct a spray of charged droplets onto a sample; and a control system arranged and adapted:

(i) to survey a sample in a first mode of operation by directing the spray of charged droplets onto the sample;

(ii) to determine one or more regions of interest in the sample; and (iii) to analyse the one or more regions of interest in a second different mode of operation by directing the spray of charged droplets onto the sample.

The control system may be arranged and adapted:

(i) to survey the sample in the first mode of operation at a first resolution; and (iii) to analyse the one or more regions of interest in the second different mode of operation at a second different resolution.

The second resolution may be greater than the first resolution.

The control system may be arranged and adapted:

(i) to survey the sample at the first resolution by directing the spray of charged droplets onto the sample when the spray has a first cross-sectional area or first pixel size at a point of impact with the sample; and (ii) to analyse the one or more regions of interest at the second different resolution by directing the spray of charged droplets onto the sample when the spray has a second different cross-sectional area or second different pixel size at a point of impact with the sample.

The second cross-sectional area or second pixel size may be smaller than the first cross-sectional area or first pixel size.

The first and/or second cross-sectional area or pixel size may be selected from the group consisting of:

(i) <100 $\mu m^2$; (ii) 100-200 $\mu m^2$; (iii) 200-500 $\mu m^2$; (iv) 500-1000 $\mu m^2$; (v) 1000-2000 $\mu m^2$; (vi) 2000-5000 $\mu m^2$; (vii) 5000-10000 $\mu m^2$; (viii) 10000-20000 $\mu m^2$; (ix) 20000-40000 $\mu m^2$; (x) 40000-60000 $\mu m^2$; (xi) 60000-80000 $\mu m^2$; (xii) 80000-100000 $\mu m^2$; (xiii) 0.1-0.2 $mm^2$; (xiv) 0.2-0.4 $mm^2$; (xv) 0.4-0.6 $mm^2$; (xvi) 0.6-0.8 $mm^2$; (xvii) 0.8-1 $mm^2$; (xviii) 1-1.2 $mm^2$; (xix) 1.2-1.4 $mm^2$; (xx) 1.4-1.6 $mm^2$; (xxi) 1.6-1.8 $mm^2$; (xxii) 1.8-2 $mm^2$; and (xxiii) >2 $mm^2$.

The control system may be arranged and adapted:

(i) to survey the sample in the first mode of operation by scanning the spray of charged droplets across the sample; and (iii) to analyse the one or more regions of interest in the second different mode of operation by scanning the spray of charged droplets across the one or more regions of interest.

The control system may be arranged and adapted:

(i) to survey the sample in the first mode of operation by scanning the spray of charged droplets across the sample at a first speed; and (iii) to analyse the one or more regions of interest in the second different mode of operation by scanning the spray of charged droplets across the one or more regions of interest at a second different speed.

The first speed may be greater than the second speed.

The control system may be arranged and adapted:

(i) to survey the sample in the first mode of operation by directing the spray of charged droplets onto a plurality of first target regions of the sample; and (iii) to analyse the one or more regions of interest in the second different mode of operation by directing the spray of charged droplets onto a plurality of second target regions of the one or more regions of interest.

The control system may be arranged and adapted:

(i) to survey the sample in the first mode of operation by directing the spray of charged droplets onto a plurality of first target regions of the sample, and to direct the spray of charged droplets onto each of the plurality of first target regions for a first dwell time; and (iii) to analyse the one or more regions of interest in the second different mode of operation by directing the spray of charged droplets onto a plurality of second target regions of the one or more regions of interest, and to direct the spray of charged droplets onto each of the plurality of second target regions for a second different dwell time.

The first dwell time may be less than the second dwell time.

The first and/or second dwell time may be selected from the group consisting of: (i) <0.1 s; (ii) about 0.1-0.2 s; (iii) about 0.2-0.4 s; (iv) about 0.4-0.6 s; (v) about 0.6-0.8 s; (vi) about 0.8-1 s; (vii) about 1-1.2 s; (viii) about 1.2-1.4 s; (ix) about 1.4-1.6 s; (x) about 1.6-1.8 s; (xi) about 1.8-2 s; and (xii) >2 s.

The control system may be arranged and adapted:

(i) to survey the sample in the first mode of operation during a first time period; and (iii) to analyse the one or more regions of interest in the second different mode of operation during a second time period.

The first time period may be less than the second time period.

The first and/or second time period may be selected from the group consisting of: (i) <30 s; (ii) about 30-60 s; (iii) about 1-2 min; (iv) about 2-5 min; (v) about 5-10 min; (vi) about 10-20 min; (vii) about 20-40 min; (viii) about 40-60 min; (ix) about 60-80 min; (x) about 80-100 min; (xi) about 100-120 min; and (xii) >120 min.

The control system may be arranged and adapted:

(i) to survey the sample in the first mode of operation by directing the spray of charged droplets onto one or more first regions of the sample; and (iii) to analyse the one or more regions of interest in the second different mode of operation by directing the spray of charged droplets onto the one or more regions of interest;

wherein at least some of the one or more regions of interest may be the same as or overlap with at least some of the one or more first regions.

At least (i) 1%, (ii) 5%, (iii) 10%, (iv) 20%, (v) 30%, (vi) 40%, (vii) 50%, (viii) 60%, (ix) 70%, (x) 80%, (xi) 90%, (xii) 95%, or (xiii) 99% of the one or more regions of interest may be the same as or overlap with the one or more first regions.

The control system may be arranged and adapted:

(i) to survey the sample in the first mode of operation by analysing most or all of the area of the sample.

The control system may be arranged and adapted:

(i) to survey the sample in the first mode of operation by analysing at least (i) 50%, (ii) 60%, (iii) 70%, (iv) 80%, (v) 90%, (vi) 95%, or (vii) 99% of the area of the sample.

The control system may be arranged and adapted:

(i) to survey the sample in the first mode of operation by directing the spray of charged droplets onto the sample, wherein the charged droplets have a first polarity; and (iii) to analyse the one or more regions of interest in the second different mode of operation by directing the spray of charged droplets onto the sample, wherein the charged droplets have a second different polarity.

The device may be arranged and adapted to direct solvent ions onto the sample.

The control system may be arranged and adapted:

(i) to survey the sample in the first mode of operation by directing the spray of charged droplets onto the sample, wherein the charged droplets comprise a first solvent or solvent composition; and (iii) to analyse the one or more regions of interest in the second different mode of operation by directing the spray of charged droplets onto the sample, wherein the charged droplets comprise a second different solvent or solvent composition.

The first and/or second mode of operation may comprise:

a mass spectrometry ("MS") mode of operation; a tandem mass spectrometry ("MS/MS") mode of operation; a mode of operation in which parent or precursor ions are alternatively fragmented or reacted to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation; a Quantification mode of operation; or an Ion Mobility Spectrometry ("IMS") mode of operation.

The first and/or second mode of operation may comprise:

(i) a Collisional Induced Dissociation ("CID") mode of operation; (ii) a Surface Induced Dissociation ("SID") mode of operation; (iii) an Electron Transfer Dissociation ("ETD") mode of operation; (iv) an Electron Capture Dissociation ("ECD") mode of operation; (v) an Electron Collision or Impact Dissociation mode of operation; (vi) a Photo Induced Dissociation ("PID") mode of operation; (vii) a Laser Induced Dissociation mode of operation; (viii) an infrared radiation induced dissociation mode of operation; (ix) an ultraviolet radiation induced dissociation mode of operation; (x) a nozzle-skimmer interface fragmentation mode of operation; (xi) an in-source fragmentation mode of operation; (xii) an in-source Collision Induced Dissociation mode of operation; (xiii) a thermal fragmentation mode of operation; (xiv) an electric field induced fragmentation mode of operation; (xv) a magnetic field induced fragmentation mode of operation; (xvi) an enzyme digestion or enzyme degradation fragmentation mode of operation; (xvii) an ion-ion reaction fragmentation mode of operation; (xviii) an ion-molecule reaction fragmentation mode of operation; (xix) an ion-atom reaction fragmentation mode of operation; (xx) an ion-metastable ion reaction fragmentation mode of operation; (xxi) an ion-metastable molecule reaction fragmentation mode of operation; (xxii) an ion-metastable atom reaction fragmentation mode of operation; (xxiii) an ion-ion reaction mode of operation wherein ions react to form adduct or product ions; (xxiv) an ion-molecule reaction mode of operation wherein ions react to form adduct or product ions; (xxv) an ion-atom reaction mode of operation wherein ions react to form adduct or product ions; (xxvi) an ion-metastable ion reaction mode of operation wherein ions react to form adduct or product ions; (xxvii) an ion-metastable molecule reaction mode of operation wherein ions react to form adduct or product ions; (xxviii) an ion-metastable atom reaction mode of operation wherein ions react to form adduct or product ions; or (xxix) an Electron Ionisation Dissociation ("EID") mode of operation.

The second mode of operation may comprise an optimised version of the first mode of operation.

The control system may be arranged and adapted to select and/or optimise the second mode of operation based on information acquired during the first mode of operation.

The control system may be arranged and adapted:

(i) to survey the sample and one or more regions surrounding the sample by directing the spray of charged droplets onto the sample and onto the one or more regions surrounding the sample.

The sample may be mounted on a substrate or slide; and the control system may be arranged and adapted to (i) survey most or all of the area of the substrate or slide including the sample.

The control system may be arranged and adapted:

(i) to survey at least (i) 50%, (ii) 60%, (iii) 70%, (iv) 80%, (v) 90%, (vi) 95%, or (vii) 99% of the area of the substrate or slide including the sample.

The control system may be arranged and adapted:

(ii) to determine one or more boundaries of the sample.

The control system may be arranged and adapted:

(iii) to analyse most or all of the area of the sample in the second different mode of operation.

The control system may be arranged and adapted:

(i) to analyse at least (i) 50%, (ii) 60%, (iii) 70%, (iv) 80%, (v) 90%, (vi) 95%, or (vii) 99% of the area of the sample in the second different mode of operation.

The control system may be arranged and adapted:

(iii) to analyse only the sample in the second different mode of operation.

The control system may be arranged and adapted:

(ii) to determine one or more regions in the sample that have one or more particular properties.

The one or more particular properties may comprise: (i) one or more histological properties; (ii) one or more tissue types; (iii) one or more molecular types or classes; (iv) one or more ions of interest; (v) one or more disease types; and/or (v) one or more drugs or drug metabolites.

The control system may be arranged and adapted:

(i) to survey most or all of the sample in the first mode of operation;

(ii) to determine the one or more regions of interest in the sample; and then (iii) to analyse the one or more regions of interest in the second different mode of operation.

The control system may be arranged and adapted:

(i) to survey a portion of the sample in the first mode of operation;

(ii) to determine one or more regions of interest in the portion of the sample; and when one or more regions of interest are determined in the portion of the sample:

(iii) to analyse the one or more regions of interest in the second different mode of operation.

The control system may be arranged and adapted:

(iv) to survey another portion of the sample in the first mode of operation after (iii) analysing the one or more regions of interest in the second different mode of operation.

The spray of charged droplets may be arranged and adapted to generate analyte ions.

The apparatus may comprise:

a device arranged and adapted to mass analyse the analyte ions or ions derived from the analyte ions.

The apparatus may comprise:

a device arranged and adapted to determine the ion mobility, collision cross section or interaction cross section of the analyte ions or ions derived from the analyte ions.

The control system may be arranged and adapted to perform the steps (i), (ii) and (iii) during the course of a single experimental acquisition.

The control system may be arranged and adapted to perform the steps (i) and (iii) automatically without user interaction.

The control system may be arranged and adapted to perform the steps (i), (ii) and (iii) automatically without user interaction.

The control system may be arranged and adapted to load the sample into the apparatus automatically without user interaction.

The control system may be arranged and adapted to repeat the steps (i), (ii) and (iii) a plurality of times for a plurality of different samples.

The control system may be arranged and adapted to automatically repeat the steps (i), (ii) and (iii) the plurality of times for the plurality of different samples without user interaction.

The sample may comprise: (i) a tissue section; (ii) a living or non-living tissue sample; and/or (iii) a histopathology sample.

The device may be arranged and adapted to direct the spray of charged droplets onto the sample at about atmospheric pressure.

The device may be a Desorption Electrospray Ionisation ("DESI") ion source.

According to an aspect there is provided a method of ionising a sample comprising:

directing a spray of charged droplets onto a sample; and varying the cross-sectional area or spot size of the spray of charged droplets at a point of impact with the sample.

The method may comprise a Desorption Electrospray Ionisation ("DESI") method.

According to an aspect there is provided an ion source comprising:

a device arranged and adapted to direct a spray of charged droplets onto a sample;

wherein the cross-sectional area or spot size of the spray of charged droplets at a point of impact with the sample is variable.

The ion source may comprise a Desorption Electrospray Ionisation ("DESI") ion source.

BRIEF DESCRIPTION OF THE DRAWINGS

Various embodiments will now be described, by way of example only, and with reference to the accompanying drawings in which.

DETAILED DESCRIPTION

Figure 1A:
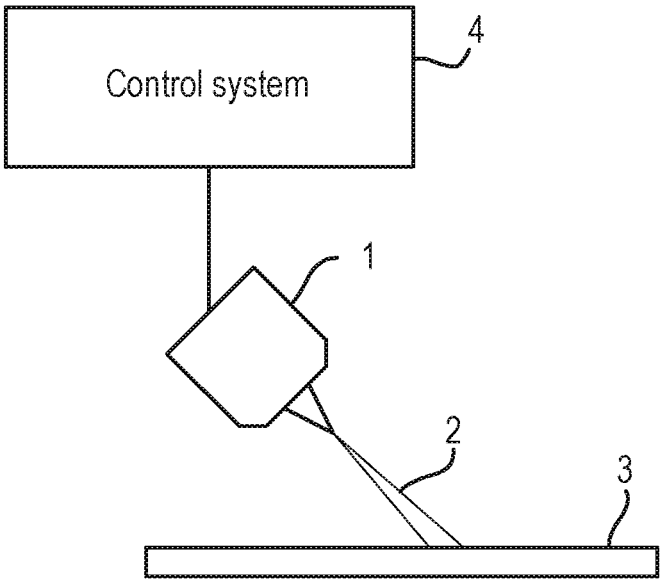
FIG. 1A shows an embodiment in which a spray of charged droplets is directed onto a sample with a relatively small spot size and FIG. 1B shows an embodiment in which a spray of charged droplets is directed onto a sample with a relatively large spot size.

Embodiments disclosed herein provide a method of and apparatus for imaging a sample, in which the sample is surveyed in a first mode of operation by directing a spray of charged droplets onto the sample (i.e., a "survey scan" is performed to produce a "survey image"), one or more regions of interest in the sample are determined based on data acquired from the survey scan (or based on analysis of the survey image), and the one or more regions of interest are then analysed in a second different mode of operation by directing a spray of charged droplets onto the sample (i.e. a subsequent "analytical scan" is performed to produce an "analytical image").

According to various embodiments, the overall analysis time for the sample can be reduced by identifying one or more regions of interest in the initial survey scan and then analysing only the identified region(s) of interest in the analytical scan. For example, the initial survey scan can generate data representing a survey image (or that can be used to produce a survey image). Analysis of the survey scan data, the survey image, or both can be used to determine the region(s) of interest for analysis in the subsequent analytical scan. In some embodiments, analysis of the survey scan data, the survey image, or both can be performed in real time, or substantially in real time, to identify one or more regions of interest for analysis in the analytical scan.

Alternatively or additionally, analysis of data collected in the survey scan (the first mode of operation that can be used to produce a survey image) can identify more than one region of interest. When more than one region of interest is identified based on the survey scan, the second mode of operation (the analytical scan that can be used to produce an analytical image) can scan regions of interest, e.g., at a higher resolution and/or using different conditions. Each region of interest identified by the survey scan can be scanned at different conditions appropriate for the particular region of interest. For example, the solvent composition, spot size, analysis or mass spectrometry ("MS") mode, or other useful conditions can be selected based on an identification from the survey scan data of the compounds in a particular region of interest.

In some embodiments, multiple analytical scans can be made of each identified region of interest. For example, the multiple analytical scans can use the same or different conditions, as discussed in more detail below, e.g., different spot sizes, solvent composition, analysis or mass spectrometry ("MS") mode, or other useful conditions.

The spray of charged droplets may be produced by a Desorption Electrospray Ionisation ("DESI") ion source, e.g., such that charged droplets and ions of solvent are electrosprayed onto the surface of the sample. The impact of the charged particles on the surface may produce gaseous ions of material originally present on the surface. These ions may then be analysed to determine their mass to charge ratio and/or ion mobility, or to determine the mass to charge ratio and/or ion mobility or ions derived from the initial ions (e.g. by fragmenting the initial ions), etc.

DESI is of particular interest in the context of imaging mass spectrometry, since it can be used to analyse a sample (e.g. tissue section) whilst leaving it virtually unaltered. Accordingly, a particular benefit of utilising DESI to analyse a sample (e.g. tissue section) in accordance with various embodiments is that DESI analysis allows for multiple interrogations of the same part of the sample (tissue section). This is not the case with many other types of ionisation, such as Matrix-Assisted Laser Desorption Ionisation ("MALDI")

Accordingly, in various embodiments, at least some of the one or more regions of interest that are sampled in the second mode of operation are the same as or overlap with at least some of the region or regions sampled in the first mode of operation. Equally, in various embodiments, most or all of the area of the sample is surveyed in the first mode of operation, such that the likelihood of missing areas of interest is substantially reduced, without affecting the subsequent scan.

Furthermore, Desorption Electrospray Ionisation ("DESI") is a versatile ionisation technique for mass spectrometry for surfaces under ambient conditions, and does not require, e.g., a sample to be under vacuum or cooled, nor time consuming sample preparation steps, etc.

According to various embodiments described herein, acquisition times and data loads for DESI analysis, e.g. in clinical applications, can be substantially reduced, and the amount of user input required can be minimized.

According to various embodiments, a sample or samples may be mounted on a slide. The entire area of the slide including the sample or samples may be surveyed by the survey scan in order to determine the boundary or boundaries of the sample(s) on the slide and/or one or more sub-regions of interest within the sample(s).

Where the boundary or boundaries of the sample(s) is determined, the subsequent scan may then be directed to only include the sample(s) within the boundary or boundaries. This approach reduces the required user input for the imaging experiment, and in particular removes the need for experiment definition such as optical image co-registration and then region of interest definition.

Where one or more sub-regions of interest within the sample are determined from the survey scan, the subsequent scan may be directed to only include the sample within the one or more sub-regions of interest.

The one or more sub-regions of interest may be determined from the survey scan by determining whether one or more regions of the sample comprise one or more molecules or ions of interest, which may be indicative of, e.g., the presence of absence of one or more tissue types in the sample, the presence of absence of one or more diseases in a tissue sample, and/or the presence of absence of one or more drugs or drug metabolites in a tissue sample.

According to various embodiments, loading the sample (e.g., on a slide) into the instrument before analysis may be automated. This is particularly useful where, for example, it is desired to analyse multiple samples (e.g., on multiple slides) in sequence.

In various embodiments, the survey scan (the first mode of operation) may comprise a low resolution mode of operation, and the subsequent scan (the second mode of operation) may comprise a high resolution mode of operation. To facilitate this, the spot size of the spray of charged droplets may be controlled to determine the resolution. In the low resolution mode of operation the spray of charged droplets may be controlled to have a relatively large spot size, while in the high resolution mode of operation the spray of charged droplets may be controlled to have a relatively small spot size. As the resolution of the scan is determined by controlling the spot size of the spray of charged droplets, the possibility of missing areas of interest in the survey scan is substantially reduced.

Figure 1B:
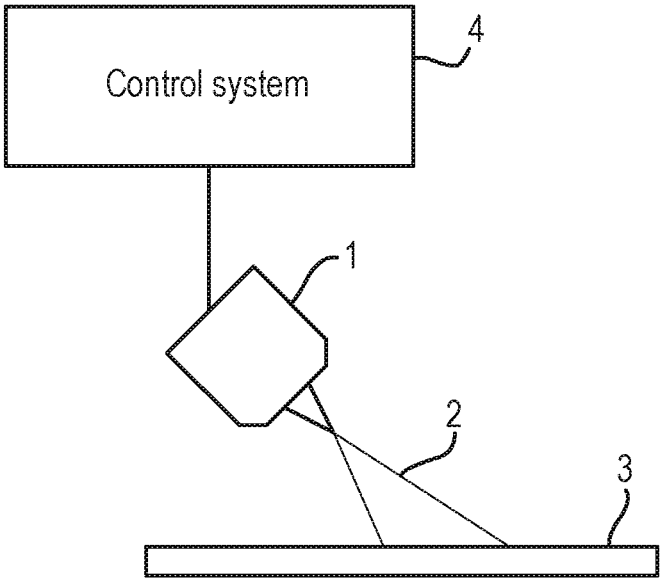

FIGS. 1A and 1B show embodiments in which a device 1 (e.g., a DESI ion source) is arranged to direct a spray of charged droplets 2 onto a sample 3. The device 1 is controlled by a control system 4 to have a variable spray spot size. For example, as shown in FIGS. 1A and 1B, the spray 2 may be controlled to have a relatively small spot size (FIG. 1A) or a relatively large spot size (FIG. 1B).

The spot size of the DESI spray 2 on the surface of the sample 3 to be analysed can be controlled and calibrated for a given range of gas pressures and solvent flows such that by automated control of these parameters (either instrument gas supply and on-board fluidics or $3^{rd}$ party hardware) the acquisition region can be matched to the pixel size of the original imaging experiment.

The survey scan (the first mode of operation) may additionally or alternatively comprise a high speed mode of operation, and the subsequent scan (the second mode of operation) may comprise a low speed mode of operation. To facilitate this, the speed at which the spray of charged droplets is scanned across the sample or the speed at which the sample is scanned relative to the spray may be controlled and/or the dwell time for which the spray of charged droplets is directed onto each target region or pixel of the sample may be controlled. In the first mode of operation, the spray of charged droplets may be controlled to dwell at each target region or pixel of the sample for a relatively short time, while in the second mode of operation, the spray of charged droplets may be controlled to dwell at each target region or pixel of the sample for a relatively long time.

It will be appreciated therefore, that the total amount of time taken to survey the sample in the first mode of operation will be substantially less than the amount of time it would otherwise take for the sample to be analysed in the second mode of operation. Equally, the total amount of time taken to survey the sample in the first mode of operation may be substantially less than the amount of time taken to analyse the one or more regions of interest in the second mode of operation.

Additionally or alternatively, the survey scan (the first mode of operation) and the subsequent scan (the second mode of operation) may comprise different analytical modes of operation, i.e., the instrument may be arranged to analyse the sample using different modes of operation in order to provide different sets of information about the sample.

For example, the survey scan (the first mode of operation) may comprise a mode of operation in which the spray of charged droplets is caused to have a first polarity (e.g., positive or negative), and the subsequent scan (the second mode of operation) may comprise a mode of operation in which the spray of charged droplets is caused to have a second different polarity (e.g., negative or positive).

Additionally or alternatively, the survey scan (the first mode of operation that can be used to produce a survey image) may comprise a mode of operation in which the spray of charged droplets comprises a first solvent or solvent composition, and the subsequent scan (the second mode of operation that can be used to produce an analytical image)

may comprise a mode of operation in which the spray of charged droplets comprises a second different solvent or solvent composition.

For example, the first solvent or solvent composition and second solvent or solvent composition can be selected to enhance signals from desired compound classes, e.g., the polarity of the solvents or solvent compositions can be selected to enhance signals from desired compound classes. In some exemplary embodiments, the first solvent or solvent composition can be selected to provide acceptable signal levels from a broad range of compound classes that may be present in a sample. The second solvent or solvent composition can then, in some cases, be selected to provide enhanced signal levels for some compounds. For example, the second solvent or solvent composition can be selected to provide enhanced signal levels from compound classes of interest that are expected to be present in the sample, or that are determined to be present based upon data obtained from the survey scan (the first mode of operation).

In another exemplary embodiment, the first solvent or solvent composition can be selected to be a less destructive solution for the survey scan (the first mode of operation), thereby allowing for improved results from the subsequent scan (the second mode of operation). Again, in such exemplary embodiments, the second solvent or solvent composition can be selected to provide enhanced signal levels from compound classes of interest that are expected to be present in the sample, or that are determined to be present based upon data obtained from the survey scan (the first mode of operation).

For example, solutions of dimethylformamide (DMF) and water can be used to enhance signals of low molecular weight compounds, such as small metabolites, fatty acids and fatty acid dimers. DMF:water solvent solutions can also be less destructive than other solvent solutions. Similarly, solutions of methanol and water can be used to enhance signals for compounds such as glycerophospholipids. Further examples of useful solvents or solvent compositions are disclosed in L. S. Eberlin et al., *Biochimica et Biophysica Acta* 1811 (2011) 946-960 and A. Badu-Tawiah, *J Am Soc Mass Spectrom* 2010, 21, 572-579, the contents and teachings of which are incorporated herein by reference.

Alternatively or additionally, the first solvent or solvent composition (used in the first mode of operation) may be chosen to provide optimal conditions for a larger spot size. The second solvent or solvent composition can then be adjusted or selected to provide optimal conditions for a smaller spot size, e.g., a spot size suitable for a high resolution scan (that can be used to produce a high resolution analytical image) when an area of interest is identified based upon the survey scan of the first mode of operation.

Additionally or alternatively, the survey scan (the first mode of operation) may comprise a particular analysis mode of operation (e.g. a mass spectrometry ("MS") mode of operation, a tandem mass spectrometry ("MS/MS") mode of operation, a fragmentation mode of operation, etc.) and the subsequent scan (the second mode of operation) may comprise a different analysis mode of operation.

It would also be possible for the second mode of operation to comprise an optimised version of the first mode of operation. In these embodiments, the second mode of operation may be selected and/or optimised based on information acquired from the survey scan in the first mode of operation. For example, the first mode of operation can include a (mass spectrometry ("MS")) neutral loss survey to identify potential locations of interest, e.g., metabolite locations of a drug of interest. The second mode of operation can include high resolution mass spectrometry ("MS") imaging of the locations of interest identified in the first mode of operation, e.g. high resolution mass spectrometry ("MS") imaging of metabolite locations of a drug of interest.

As discussed above, analysis of data collected in the survey scan (the first mode of operation that can be used to produce a survey image) can identify more than one region of interest. When more than one region of interest is identified based on the survey scan, the second mode of operation (the analytical scan that can be used to produce an analytical image) can scan regions of interest, e.g., at a higher resolution and/or using different conditions. Each region of interest identified by the survey scan can be scanned at different conditions appropriate for the given region of interest. For example, the solvent composition, spot size, analysis or mass spectrometry ("MS") mode, or other useful conditions can be selected based on an identification of the sample in a particular region of interest.

In some embodiments, multiple analytical scans can be made of each identified region of interest. For example, the multiple analytical scans can use the same or different conditions, as discussed in more detail herein, e.g., different spot sizes, solvent composition, analysis or mass spectrometry ("MS") mode, or other useful conditions.

According to an embodiment a slide having a tissue sample to be analysed may be mounted or loaded (manually or robotically) into an instrument. A rapid survey scan of the whole slide may then be conducted, e.g., within a time frame of about 1 minute. The initial rapid scan may be used to define the boundaries of the tissue section on the slide. The initial rapid scan may also be used to create one or more co-ordinate lists for subsequent analytical resolution scanning.

The implementation of an initial rapid scan step may be implemented at high mass spectrometer ("MS") scan speeds (e.g., 10 scans per second) whilst using a relatively large analysis spray spot size (e.g., approx. 1 mm). Since biological tissue has a significantly different molecular profile to that of a substrate (e.g. glass slide) then tissue samples can be readily located chemically on to the slide. This allows the position of tissue sections on the slide to be identified quicker than the time it would take to manually co-register an optical image and define regions.

Accordingly, one functionality of a combined survey scan followed by analysis scan, which may be performed according to various embodiments, is to use a rapid initial scan (e.g., about 1 minute) to detect tissue section boundaries. Having identified the boundaries of a tissue section, the tissue section may then be analysed at a desired spatial resolution and/or desired mass spectrometer scan speed.

It will be appreciated that the approach according to the various embodiments is advantageous when considering even a single slide. However, the benefits of the various embodiments become even more apparent when the approach is applied to a system wherein numerous (e.g., 20 or more) slides may be arranged to be automatically loaded into the system. According to various embodiments the slides may be queued prior to being loaded into the system.

Figure 2:
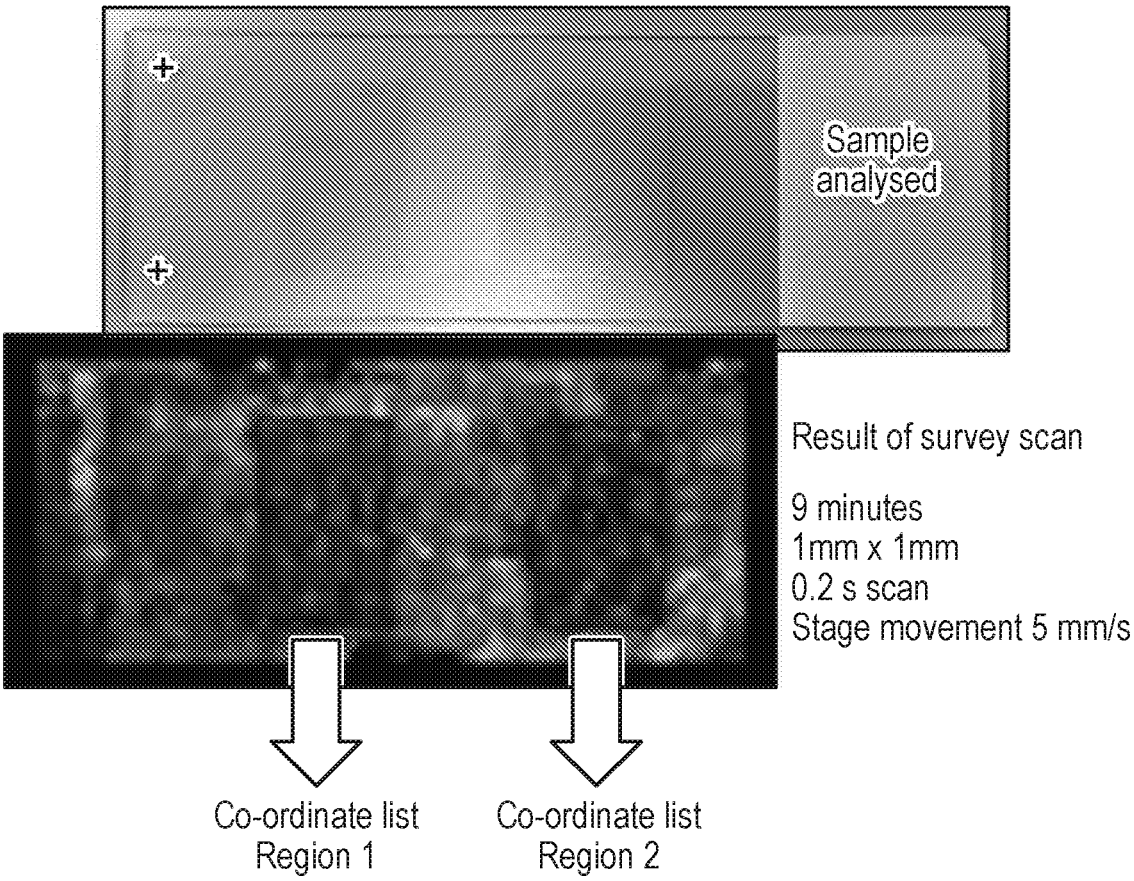
FIG. 2 shows an embodiment wherein a Desorption Electrospray Ionisation ("DESI") survey scan is automatically performed on a slide when the slide is loaded onto a system according to an embodiment.

FIG. 2 shows an approach according to an embodiment wherein an initial DESI survey scan is performed automatically on a slide as the slide is loaded onto or into the system. Tissue may be identified due to the difference in background between that of the tissue and the slide. Tissue regions may then be subsequently analysed at a much smaller pixel size for histologically relevant data.

In the case of the example shown in FIG. 2 an initial survey scan was performed which took 9 minutes and was performed at a pixel spacing of 1 mm×1 mm with a 0.2 s scan for each pixel, and with a stage movement speed of 5 mm/s. A first co-ordinate list region and a second co-ordinate list region were obtained.

Other than this initial tissue position localization mode of operation, other modes of operation may also be performed. For example, an image of a sample, such as a cancer related biopsy section, a drug dosed mouse section or a mouse disease model section, will contain regions which are of no interest to the analyst. However, according to conventional approaches, regions which are of no interest will still be imaged at the native spatial resolution of the experiment, resulting in a significant waste of time and data storage resource.

Embodiments are disclosed that relate to the determination of the classification of the tissue based upon the initial survey scan. The tissue section may be automatically re-analysed at a higher resolution or in a different mass spectrometry ("MS") mode of operation (e.g., different polarity ionisation or a MS/MS mode of operation may be employed). By providing a means of directing the higher resolution imaging (or different MS mode acquisition) significant time and data size savings can be made.

According to various embodiments the system may initially operate utilising a relatively large DESI spot size to conduct an initial scan in a very short time frame. Identification of characteristic spectra of a certain tissue type, or specific ions of interest, may be used to flag large pixels for further analysis.

According to a post-acquisition method an initial survey scan may be completed and then regions of interest may be highlighted for a user to then select and interrogate, e.g., at an increased spatial resolution. For example, imaging may be performed initially with a pixel spacing of 1 mm×1 mm and then attention may be directed onto specific regions using a substantially smaller pixel size in the range 50-100 μm. Thus, all of the sample may be initially surveyed, before the one or more regions of interest are analysed.

According to an on-the-fly mode of operation the system may be operated in an identify and flood fill mode wherein once a discrete region has been fully defined in the survey scan then this particular region may then automatically be imaged, e.g., at a higher resolution, before the survey scan continues or resumes, e.g., at the broad spot analysis.

Thus, in some embodiments, part of the sample may be surveyed and then analysed in more detail before the remainder of the sample is surveyed. As soon as a region of interest is determined in the survey scan, it may be analysed in the second mode of operation. After the region of interest has been analysed in the second mode of operation, the instrument may return to the first mode of operation to continue with and/or complete the survey scan.

In some exemplary embodiments, the entire process of surveying the sample, determining one or more areas of interest, and analysing the sample may be automated, e.g. without requiring user interaction. However, it would also be possible for the determination of the one or more areas of interest to include at least some user interaction. For example, a user may select one or more areas of interest for analysis in the second mode of operation (e.g. from the survey scan data, the survey image, or both), or from plural (potential) areas of interest that have been automatically identified.

In some embodiments, the determination (identification) of the one or more regions of interest (and/or the selection or optimisation of the second mode of operation) based on data acquired in the survey scan may be performed in realtime. The determination or selection may be based on an identification of a particular sample or sample type of interest in the survey scan. The analysis of the one or more regions of interest may be performed automatically in response to the identification of a particular sample or sample type of interest in the survey scan, i.e., in a Data Directed Analysis ("DDA") mode of operation. Thus, for example, the region of interest selection may be triggered as a consequence of a real time sample identification ("real time ID").

Accordingly, data acquired in the survey scan (in the first mode of operation) may be monitored (in real-time) in order to identify one or more samples or sample types of interest, and when one or more samples or sample types of interest are identified, then one or more regions or interest may be analysed (in the second mode of operation) in response to the identification.

In various embodiments, the determination of the one or more regions of interest (and/or the selection or optimisation of the second mode of operation) may be based on multivariate analysis of the survey scan data such as Principle Component Analysis ("PCA") identification, and/or methods of discriminating between known groups such as Linear Discriminant Analysis ("LDA") identification, and/or pattern matching techniques. Accordingly, in some embodiments, one or more sample mass spectra obtained for a particular region of the sample during the survey scan may be subjected to multivariate analysis in order to determine whether or not that region is of interest.

For example, the one or more sample mass spectra obtained for the particular region may be classified using principal component analysis (PCA) and linear discriminant analysis (LDA). In these embodiments, PCA of training data for known substances (e.g., different tissue types) may be carried out in order to define a suitable PCA space and then linear discriminant analysis (LDA) may be performed on the data in the PCA space in order to identify classes of substances. Intensity data derived from the one or more sample mass spectra can be projected into the PCA space and classified according to distances (e.g., squared Mahalanobis distances) to the classes of substances identified by the LDA.

In some embodiments, the particular region may be classified as being of interest when the shortest distance or shortest distances that are calculated for the one or more sample mass spectra for the region are to one or more classes containing one or more particular substances of interest.

In other embodiments, one or more sample mass spectra obtained for a particular region of the sample during the survey scan may be subjected to a pattern matching algorithm in order to determine whether or not that region is of interest.

For example, a pattern recognition search algorithm, e.g., as embodied in Waters' MicrobeLynx™ software, may be used to determine the probability that the one or more sample mass spectra match one or more mass spectra for known substances that are stored in a database. In some embodiments, the region may be classified as being of interest when the highest calculated probability or probabilities of a match are between the one or more sample mass spectra for the region and one or more mass spectra in the database that relate to one or more particular substances of interest.

The above classification approaches may also be used to classify one or more sample mass spectra obtained during the analytical scan. Thus, in some embodiments, one or more sample mass spectra obtained during the analytical scan may be classified using multivariate analysis (e.g., PCA-LDA). In other embodiments, one or more sample mass spectra obtained during the analytical scan may be classified using a pattern matching algorithm (e.g., the pattern recognition search algorithm embodied in Waters' Microbelynx™ software).

In further embodiments, other classification approaches may be used for the survey scan and/or analytical scan, such as: principal component analysis (PCA); probabilistic PCA; incremental PCA; non-negative PCA; kernel PCA; soft independent modelling of class analogy (SIMCA); factor analysis; recursive partitioning (decision trees); random forests; independent component analysis (ICA); partial least squares discriminant analysis (PLS-DA); orthogonal (partial least squares) projections to latent structures (OPLS); OPLS discriminant analysis (OPLS-DA); linear discriminant analysis (LDA); incremental LDA; maximum margin criterion (MMC); support vector machines (SVM); artificial neural networks; multilayer perceptron; radial basis function networks (RBF networks); Bayesian analysis; cluster analysis; kernelized methods; and/or a combination of the foregoing classification approaches (e.g., PCA-LDA, PCA-MMC, PLS-LDA, etc.).

In various embodiments, all of the (e.g., mass spectral) data collected, i.e. in the survey scan and the analytical scan, may be stored, e.g., in memory for subsequent analysis or otherwise.

Alternatively, the survey scan data (or survey image) may be discarded (not stored), and (only) the analytical scan data (i.e. the region of interest data) may be stored. For example, the survey scan data (or survey image) can be used to determine the region(s) of interest that will be scanned in an analytical scan or scans but the survey scan data (or survey image) itself need not be stored once the determination of a region of interest is made. Alternatively, the survey scan data (or survey image) can be stored until an analytical scan or scans has been completed and then the survey scan data (or survey image) can be discarded.

Additionally or alternatively, sample identification information for each pixel (e.g., tissue ID information such as information indicating whether or not the sample (tissue) is healthy, a disease type (e.g. cancer type), and/or a tissue type (e.g. blood vessel, muscle, etc.)) may be stored, and underlying the mass spectral data used to make the sample identification may be discarded. Such methods for optimising data storage can beneficially reduce the size of the resulting data file, which would otherwise be relatively large.

Figure 3:
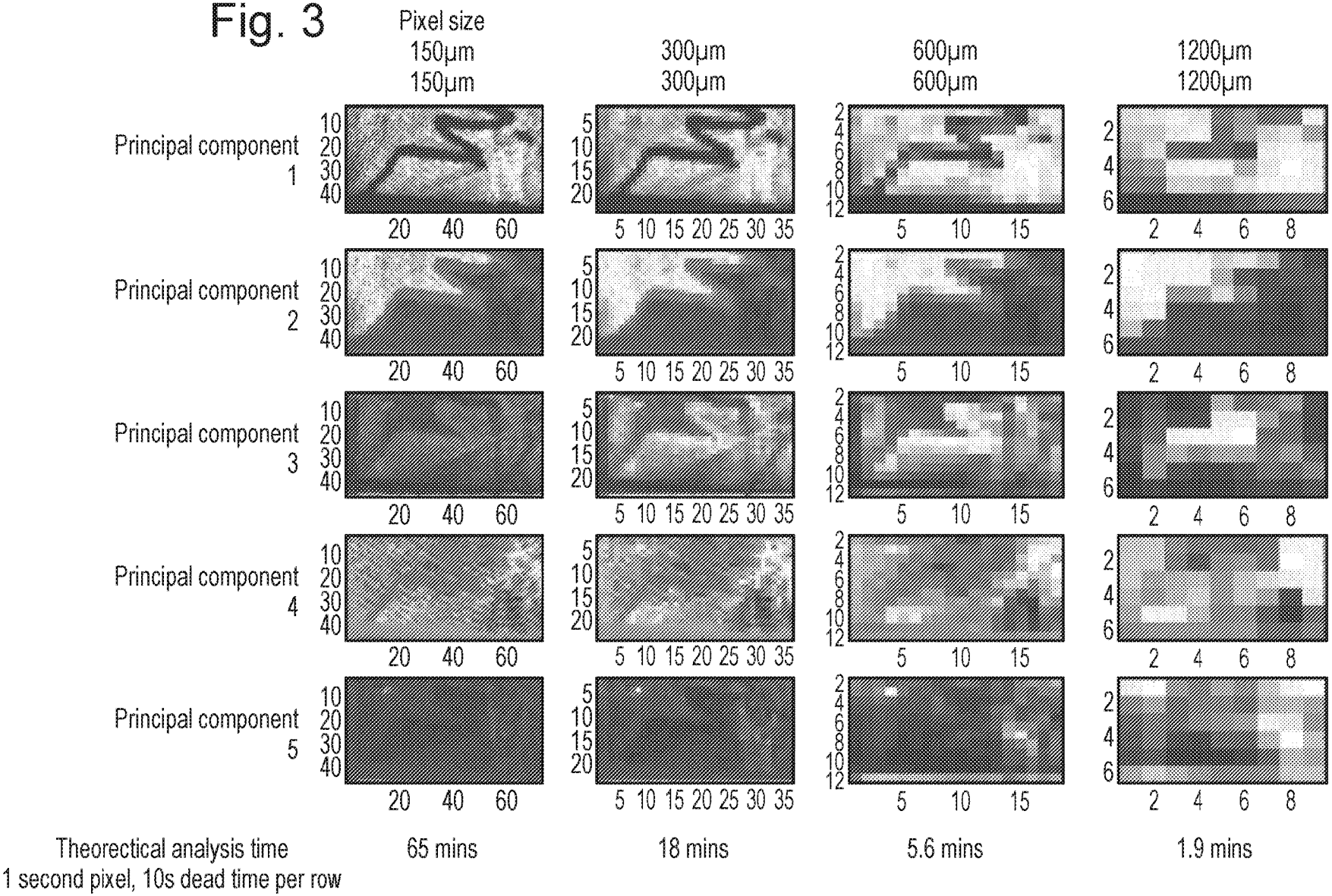
FIG. 3 shows a simulated pixel variation analysis of a patterned surface using DESI.

FIG. 3 shows a simulated pixel variation analysis of a patterned surface with DESI. An initial experiment was carried out with a pixel size of 150×150 μm. Pixels were then averaged in groups of 2×2 in each successive step. FIG. 2 demonstrates the first five principal components.

FIG. 3 demonstrates that by binning pixels the results of the principal component analysis are consistent with, for example, the small feature in the top left of principal component 5 being conserved in all but the largest pixel size (1200×1200 μm).

The workflow may be integrated into the acquisition software (FIG. 4) wherein a robust and validated pixel classifying algorithm may be implemented to process data from an initial coarse survey scan in order to define the following experiments based on preselected criteria.

Figure 4:
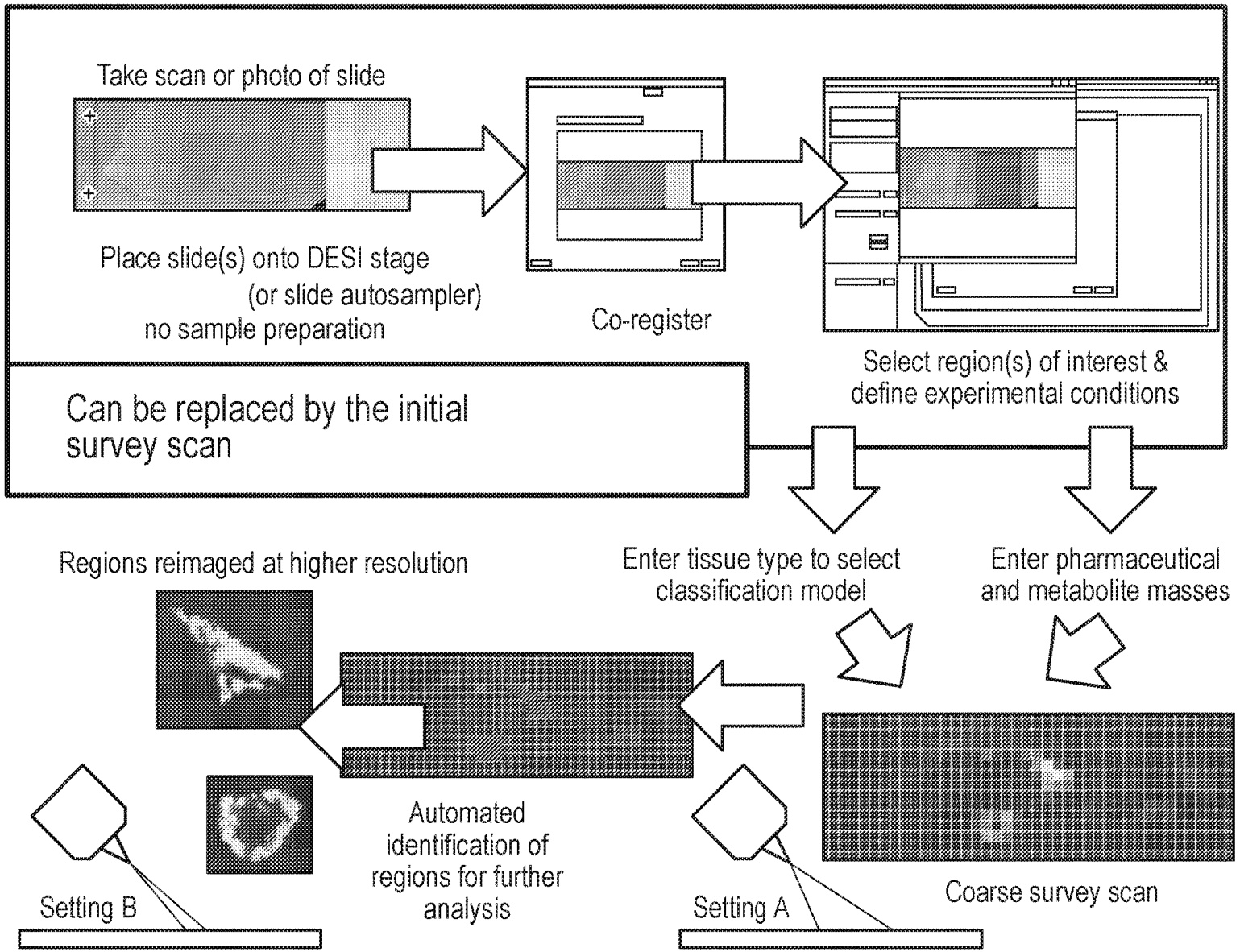
FIG. 4 shows an experimental workflow as applied to a drug metabolism and pharmacokinetics ("DMPK") study.

FIG. 4 shows an experimental workflow as applied to a drug metabolism and pharmacokinetics ("DMPK") study. Only regions with significant signal from the drug/metabolite are selected for the higher spatial resolution imaging.

It will be appreciated that different rules may be followed. For example, according to various embodiments the following rules may be followed: (i) higher spatial resolution imaging may be performed of specific tissue types only; (ii) dual polarity imaging of specific tissue types may be performed, e.g., an initial survey scan may be performed in a first polarity mode of operation and the system may return to analyse specified regions in a second different polarity mode of operation; (iii) MS/MS mapping of regions where parent ions are found during full scan for confirmatory purposes; and (iv) different solvent compositions (utilising a binary solvent pump) may be utilised for different molecular classes, e.g., as discussed above.

Figure 5:
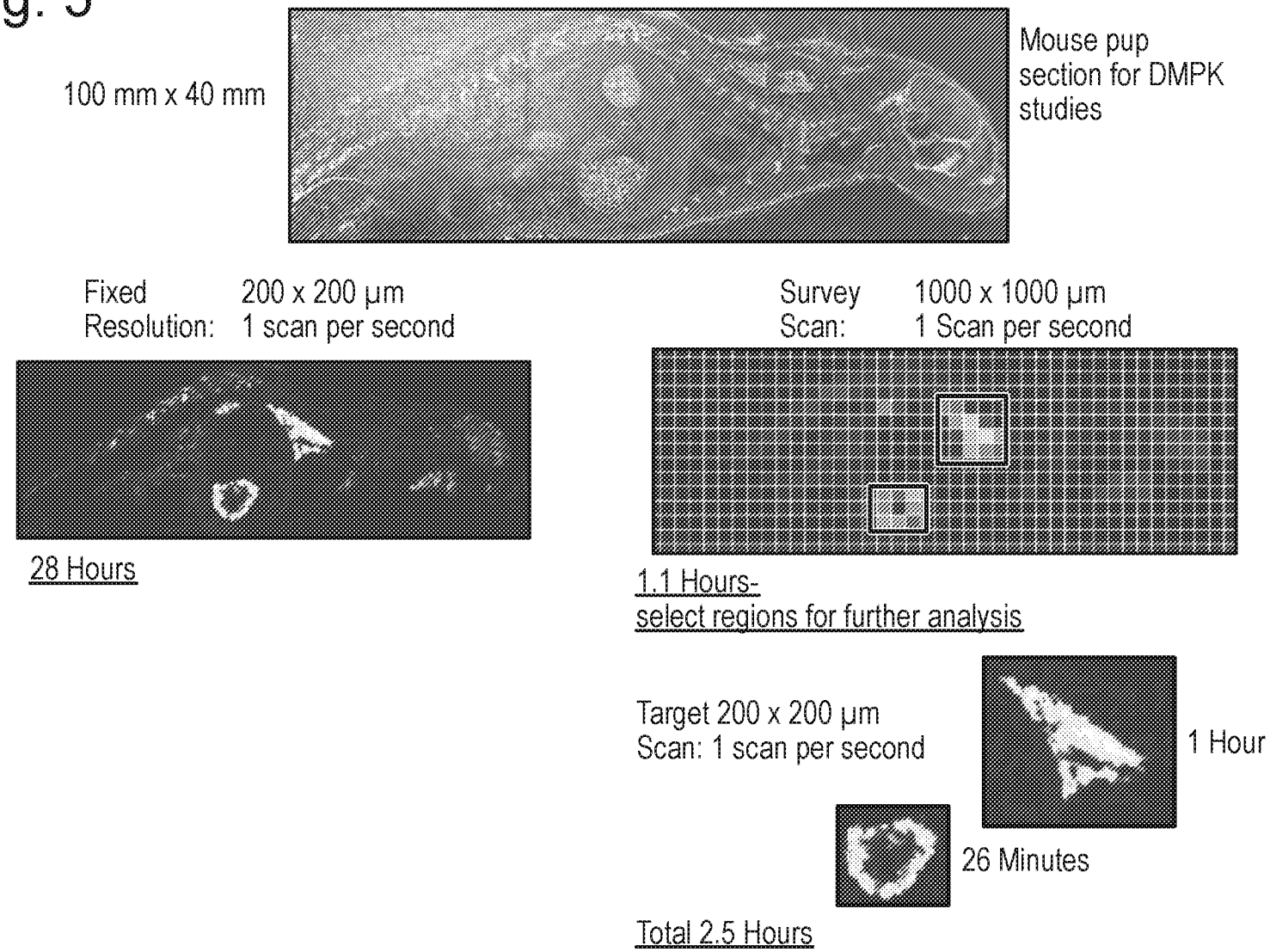
FIG. 5 shows a simulated example of acquisition speed up with multi-resolution imaging approach according to an embodiment.

FIG. 5 shows a simulated example which illustrates the benefit of a significant improvement in acquisition time together with multi-resolution imaging according to an embodiment. As shown in the example shown in FIG. 5, if the localization of a drug were required to be determined within an organ at 200 μm resolution then a conventional approach would take over a day in order to perform the analysis. By way of contrast, according to an embodiment the analysis time can be significantly reduced to just 2.5 hours by utilising an initial 1 mm pixel size survey scan followed by a targeted 200 μm pixel size of a target area of interest.

It will be appreciated that the range of operational modes of a system according to various embodiments is relatively diverse. For example, according to various embodiments the system may allow for 3D imaging experiments to be performed and analysed which rely on a series of sections on various slides.

It will be appreciated that a according to various embodiments a method of DESI ionisation of a tissue sample is disclosed wherein a controllable DESI sampling spot is used. According to various embodiments imaging scans may be performed at different speeds and spatial resolutions dependent upon the data collected with the significant benefit of reducing acquisition times and data size. Furthermore, the various embodiments result in a process which significantly reduces the need for user involvement.

Although the present invention has been described with reference to preferred embodiments, it will be understood by those skilled in the art that various changes in form and detail may be made without departing from the scope of the invention as set forth in the accompanying claims.

The invention claimed is:

1. A method of analysing a sample comprising:

(i) surveying a sample in a first mode of operation by directing a spray of charged droplets onto said sample when said spray has a first cross-sectional area or first pixel size at a point of impact with said sample and scanning said spray of charged droplets across said sample at a first speed;

(ii) determining one or more regions of interest in said sample; and (iii) analysing said one or more regions of interest in a second different mode of operation by directing a spray of charged droplets onto said sample when said spray has a second different cross-sectional area or second different pixel size at a point of impact with said sample and scanning said spray of charged droplets across said one or more regions of interest at a second different speed.

2. A method as claimed in claim 1, wherein:

the step of (i) surveying said sample in said first mode of operation comprises surveying said sample by directing said spray of charged droplets onto a plurality of first target regions of said sample, wherein said spray of charged droplets is directed onto each of said plurality of first target regions for a first dwell time; and the step of (iii) analysing said one or more regions of interest in said second different mode of operation comprises analysing said one or more regions of interest by directing said spray of charged droplets onto a plurality of second target regions of said one or more regions of interest, wherein said spray of charged droplets is directed onto each of said plurality of second target regions for a second different dwell time.

3. A method as claimed in claim 1, wherein:

the step of (i) surveying said sample in said first mode of operation comprises surveying said sample in said first mode of operation during a first time period; and the step of (iii) analysing said one or more regions of interest in said second different mode of operation comprises analysing said one or more regions of interest in said second mode of operation during a second time period.

4. A method as claimed in claim 1, wherein:

the step of (i) surveying said sample in said first mode of operation comprises directing said spray of charged droplets onto one or more first regions of said sample; and the step of (iii) analysing said one or more regions of interest in said second different mode of operation comprises directing said spray of charged droplets onto said one or more regions of interest;

wherein at least some of said one or more regions of interest are the same as or overlap with at least some of said one or more first regions.

5. A method as claimed in claim 1, wherein:

the step of (i) surveying said sample in said first mode of operation comprises directing said spray of charged droplets onto said sample, wherein said charged droplets have a first polarity; and the step of (iii) analysing said one or more regions of interest in said second different mode of operation comprises directing said spray of charged droplets onto said sample, wherein said charged droplets have a second different polarity.

6. A method as claimed in claim 1, wherein:

the step of (i) surveying said sample in said first mode of operation comprises directing said spray of charged droplets onto said sample, wherein said charged droplets comprise a first solvent or solvent composition; and the step of (iii) analysing said one or more regions of interest in said second different mode of operation comprises directing said spray of charged droplets onto said sample, wherein said charged droplets comprise a second different solvent or solvent composition.

7. A method as claimed in claim 1, wherein said first and/or second mode of operation comprises: (i) a mass spectrometry ("MS") mode of operation; (ii) a tandem mass spectrometry ("MS/MS") mode of operation; (iii) a mode of operation in which parent or precursor ions are alternatively fragmented or reacted to produce fragment or product ions, and not fragmented or reacted or fragmented or reacted to a lesser degree; (iv) a Multiple Reaction Monitoring ("MRM") mode of operation; (v) a Data Dependent Analysis ("DDA") mode of operation; (vi) a Data Independent Analysis ("DIA") mode of operation; (vii) a Quantification mode of operation; or (viii) an Ion Mobility Spectrometry ("IMS") mode of operation.

8. A method as claimed in claim 1, wherein said first and/or second mode of operation comprises: (i) a Collisional Induced Dissociation ("CID") mode of operation; (ii) a Surface Induced Dissociation ("SID") mode of operation; (iii) an Electron Transfer Dissociation ("ETD") mode of operation; (iv) an Electron Capture Dissociation ("ECD") mode of operation; (v) an Electron Collision or Impact Dissociation mode of operation; (vi) a Photo Induced Dissociation ("PID") mode of operation; (vii) a Laser Induced Dissociation mode of operation; (viii) an infrared radiation induced dissociation mode of operation; (ix) an ultraviolet radiation induced dissociation mode of operation; (x) a nozzle-skimmer interface fragmentation mode of operation; (xi) an in-source fragmentation mode of operation; (xii) an in-source Collision Induced Dissociation mode of operation; (xiii) a thermal fragmentation mode of operation; (xiv) an electric field induced fragmentation mode of operation; (xv) a magnetic field induced fragmentation mode of operation; (xvi) an enzyme digestion or enzyme degradation fragmentation mode of operation; (xvii) an ion-ion reaction fragmentation mode of operation; (xviii) an ion-molecule reaction fragmentation mode of operation; (xix) an ion-atom reaction fragmentation mode of operation; (xx) an ion-metastable ion reaction fragmentation mode of operation; (xxi) an ion-metastable molecule reaction fragmentation mode of operation; (xxii) an ion-metastable atom reaction fragmentation mode of operation; (xxiii) an ion-ion reaction mode of operation wherein ions react to form adduct or product ions; (xxiv) an ion-molecule reaction mode of operation wherein ions react to form adduct or product ions; (xxv) an ion-atom reaction mode of operation wherein ions react to form adduct or product ions; (xxvi) an ion-metastable ion reaction mode of operation wherein ions react to form adduct or product ions; (xxvii) an ion-metastable molecule reaction mode of operation wherein ions react to form adduct or product ions; (xxviii) an ion-metastable atom reaction mode of operation wherein ions react to form adduct or product ions; or (xxix) an Electron Ionisation Dissociation ("EID") mode of operation.

9. A method as claimed in claim 1, further comprising selecting and/or optimising said second mode of operation based on information acquired during said first mode of operation.

10. A method as claimed in claim 1, wherein the step of (i) surveying said sample in said first mode of operation comprises surveying said sample and one or more regions surrounding said sample by directing said spray of charged droplets onto said sample and onto said one or more regions surrounding said sample.

11. A method as claimed in claim 1, wherein said sample is mounted on a substrate or slide, and the step of (i) surveying said sample in said first mode of operation comprises: surveying most or all of the area of said substrate or slide including said sample.

12. A method as claimed in claim 1, wherein the step of (ii) determining one or more regions of interest in said sample comprises determining one or more boundaries of said sample.

13. A method as claimed in claim 1, wherein the step of (iii) analysing said one or more regions of interest in said second different mode of operation comprises: analysing most or all of the area of said sample and/or analysing only said sample.

14. A method as claimed in claim 1, wherein the step of (ii) determining one or more regions of interest in said sample comprises determining one or more regions in said sample that have one or more particular properties;

wherein said one or more particular properties comprise: (i) one or more histological properties; (ii) one or more tissue types; (iii) one or more molecular types or classes; (iv) one or more ions of interest; (v) one or more disease types; and/or (v) one or more drugs or drug metabolites.

15. Apparatus for analysing a sample comprising:

a device arranged and adapted to direct a spray of charged droplets onto a sample; and a control system arranged and adapted:

(i) to survey a sample in a first mode of operation by directing said spray of charged droplets onto said sample when said spray has a first cross-sectional area or first pixel size at a point of impact with said sample and scanning said spray of charged droplets across said sample at a first speed;

(ii) to determine one or more regions of interest in said sample; and (iii) to analyse said one or more regions of interest in a second different mode of operation by directing said spray of charged droplets onto said sample when said spray has a second different cross-sectional area or second different pixel size at a point of impact with said sample and scanning said spray of charged droplets across said one or more regions of interest at a second different speed.

* * * * *